US005505118A

United States Patent [19]

Arnesen et al.

[11] Patent Number: 5,505,118

[45] Date of Patent: Apr. 9, 1996

[54] GUN BARREL VIBRATION DAMPER

[75] Inventors: Gert Arnesen, deceased, late of Fjellhamar, Norway, by Ellen E. Arnesen, Heiress; Bjørn Bergersen, Langhus, Norway

[73] Assignee: Forsvarets Forskningsinstitutt, Norway

[21] Appl. No.: 211,014

[22] PCT Filed: Sep. 8, 1992

[86] PCT No.: PCT/NO92/00143

§ 371 Date: Nov. 7, 1994

§ 102(e) Date: Nov. 7, 1994

[87] PCT Pub. No.: WO93/06427

PCT Pub. Date: Apr. 1, 1993

[30] Foreign Application Priority Data

Sep. 16, 1991 [NO] Norway ..... 913638

[51] Int. Cl.[6] ..... F41A 25/00; F41A 25/18

[52] U.S. Cl. ..... 89/14.3; 89/43.01; 89/198

[58] Field of Search ..... 89/14.3, 43.01, 89/43.02, 44.01, 177, 178, 198

[56] References Cited

U.S. PATENT DOCUMENTS

| | | | |
|---|---|---|---|
| 430,214 | 6/1890 | Maxim | 89/14.3 |
| 2,701,963 | 2/1955 | Balleisen et al. | 89/44.01 |

FOREIGN PATENT DOCUMENTS

| | | | |
|---|---|---|---|
| 203985 | 7/1939 | Switzerland | 89/14.3 |

*Primary Examiner*—Stephen C. Bentley
*Attorney, Agent, or Firm*—Bacon & Thomas

[57] ABSTRACT

A damping device for a gun barrel (1) having a muzzle brake (2) comprises a recoil brake (3) and a vibration damper (9) to prevent natural vibrations in the gun barrel when firing a shot, from propagation to the recoil brake. The connection of the vibration damper to the recoil brake (3) and the gun barrel breech (5) is such that the force transfer coupling between the breech and the recoil brake is reduced with respect to said natural vibrations. The vibration damper (9), which may take the form of a column of Belleville springs (10) is dimensioned so that the damping device as a whole has a rigidity substantially less than the recoil brake alone and forms a vibratory system with a natural frequency substantially lower than the frequency of said natural vibrations of the gun barrel when firing a shot.

7 Claims, 5 Drawing Sheets

FIG. 3a
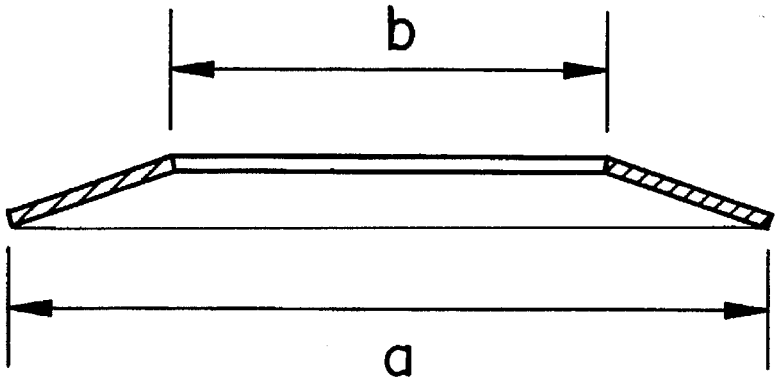
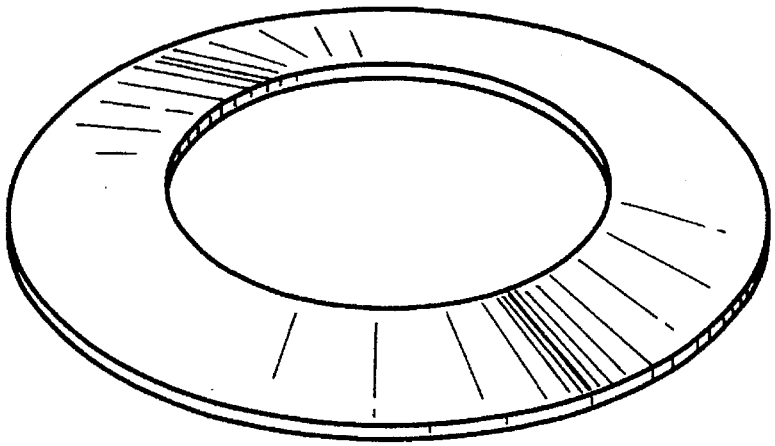
FIG. 3b

GUN BARREL VIBRATION DAMPER

TECHNICAL FIELD

The present invention relates to an elastic oscillation or vibration damper to prevent natural vibrations which, when firing a shot, arise in a gun barrel having a muzzle brake, from propagation to a recoil brake for the gun barrel. The invention also concerns a damping device for a gun barrel with a muzzle brake, comprising a recoil brake and said vibration damper.

BACKGROUND ART

It is known to provide a gun with one or more damping devices to give the recoiling parts of the gun a controlled deceleration when firing a shot. Guns of a larger caliber are in addition often provided with a muzzle brake mounted at the muzzle end of the gun barrel, serving to reverse the direction of a part of the gas flowing out behind a launched shell and thus absorb a part of the recoil forces. However, when a projectile leaves the gun barrel, the pressure of gas against the muzzle brake causes the barrel to be stretched in its longitudinal direction and the barrel is then driven into longitudinal natural vibrations or oscillations. These natural vibrations, having a frequency depending directly on the geometric design of the gun barrel and the material from which the barrel is made, are transferred to the recoil brake of the gun.

Measurements have shown that the natural vibrations of a gun barrel may cause the momentary value of the force supplied to the recoil brake to vary nearly ±100% about an average value, which corresponds substantially to the recoil force from the shell discharge itself. As a result, the maximum material tensions are also increased accordingly. When exposed to a combination of oscillating force strain and high material tensions, the risk of material fatigue is always present.

Hence, an object of the present invention is to provide an elastic vibration damper for a damping device of the type initially described, to appreciably prevent the natural vibrations of the gun barrel from propagating to the recoil brake of the gun when firing a shot.

DISCLOSURE OF THE INVENTION

The invention concerns an elastic vibration damper of the type initially described being designed to be connected to the recoil brake and a gun barrel breech in such a way that the force transfer coupling between the breech and the recoil brake is reduced with respect to the natural vibrations of the gun barrel when firing a shot; the vibration damper according to the invention being characterized in that the dimensions of the vibration damper are such that the damper along with the recoil brake form a damping device having a rigidity substantially less than the recoil brake alone and constituting a vibratory system with a natural frequency substantially lower than that of said natural vibrations of the gun barrel when firing a shot.

Advantageously, the elastic vibration damper consists of a plurality of Belleville springs, preferably of the same shape, and being assembled in such a number to form a spring column that, at maximum deflection, the springs are capable of elastically absorbing the maximum recoil force to which the recoil brake may be exposed, without the internal shearing forces in each individual spring exceeding its limit of elasticity.

The invention also concerns a damping device for a gun barrel having a muzzle brake; said device comprising a recoil brake, preferably in the form of a viscous damper, and a vibration damper to prevent natural vibrations in the gun barrel when firing a shot from propagating to the recoil brake; the vibration damper being coupled to the recoil brake and a gun barrel breech in such a way that the force transfer coupling between the breech and the recoil brake is reduced with respect to said natural vibrations. According to the invention the damping device is characterized in that the dimensions of the vibration damper, preferably being designed as a column of Belleville springs, are such that the damping device as a whole has a rigidity substantially less than the recoil brake alone and forms a vibratory system with a natural frequency substantially lower than that of the natural vibrations of the gun barrel when firing a shot.

The substantially reduced rigidity of the damping device now causes parts of the recoil forces which previously were transferred to the recoil brake to be absorbed as inertial forces in the gun barrel and components connected thereto, at the same time as the fast (i.e., high frequency) vibrations of the gun barrel to a far lesser extent are transferred to the recoil brake due to the lower natural frequency of the system.

In a preferred embodiment of the damping device according to the invention, the connection of the elastic vibration damper to the recoil brake and the gun barrel breech is designed so that the vibration damper is exposed mainly to compression when the gun is firing a shot.

A preferred embodiment of the damping device according to the invention, which is provided with a connection member for forced transfer from the gun barrel to a rod extending from one side of the connecting member to the recoil brake, when firing a shot, is characterized in that the elastic vibration damper is mounted onto a portion of the rod to the recoil brake, which is on the other side of said connecting member; the recoil brake rod being movable in relation to the connecting member, preferably by loose guidance through the connection member.

BRIEF DESCRIPTION OF THE DRAWINGS

Further features of the present invention will appear from the following description of an example of a preferred embodiment by reference to the appended drawings, on which:

FIG. 3*a* is a cross sectional and FIG. 3*b* is a perspective view, respectively, of a Belleville spring in a vibration damper according to the present invention;

DESCRIPTION OF PREFERRED EMBODIMENTS

Figure 1:
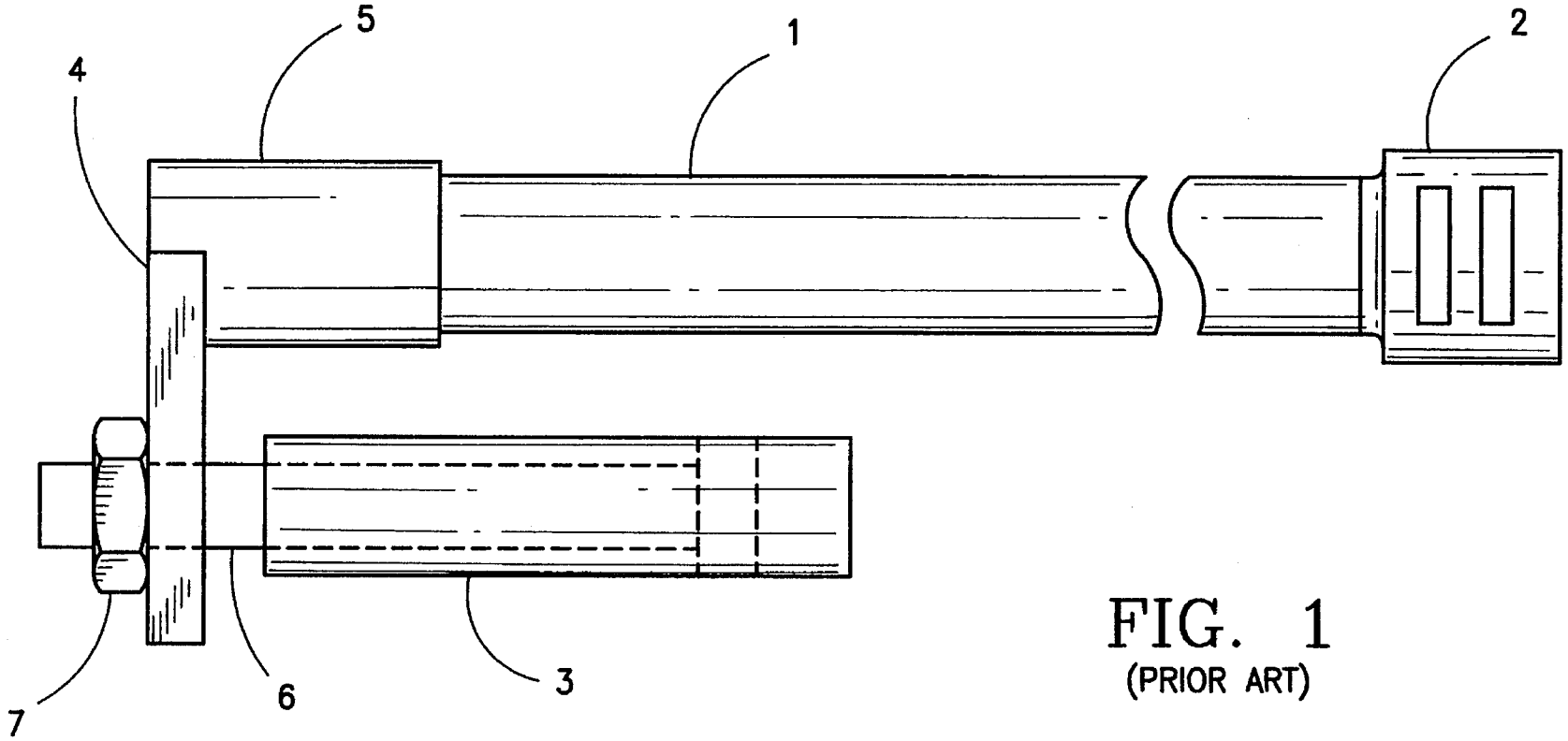
FIG. 1 (PRIOR ART)
FIG. 1 illustrates a gun barrel having a prior art recoil brake.

Reference is first made to FIG. 1, which shows a schematic outline of a gun barrel 1 provided with a muzzle brake 2 and a damping device constituted by a prior art recoil brake 3. The recoil brake 3 consists of a cylindrical hydraulic damper with piston and piston rod 6. A connecting member designed as an ear 4 is fixed to the gun barrel breech 5 for connection thereof to the rod 6 from the recoil brake, so that the recoiling parts of the gun are retarded by the recoil brake when firing the gun, the recoil brake rod 6 being permanently attached to the ear 4 by means of a lock nut 7.

Figure 2:
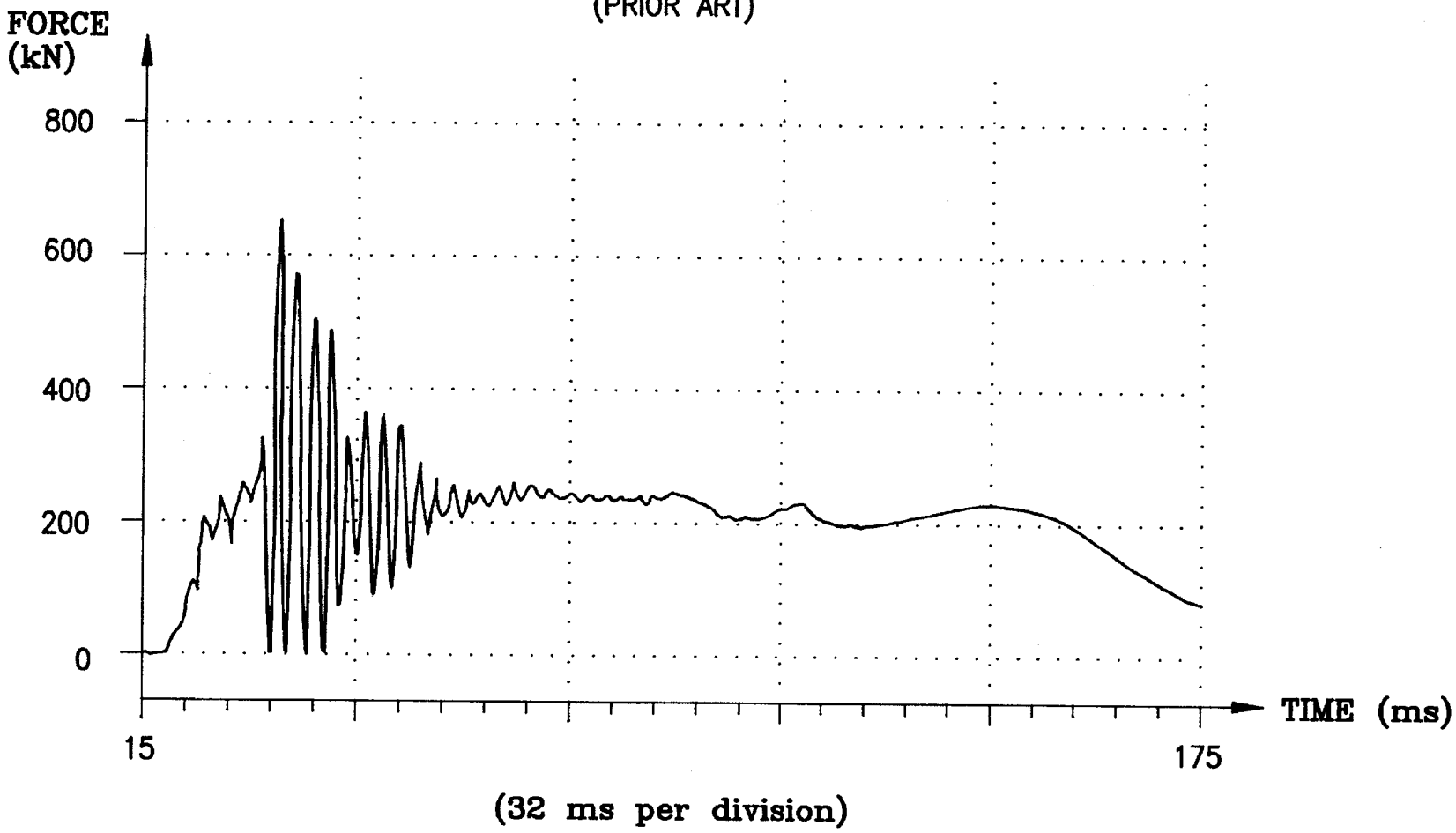
FIG. 2 (PRIOR ART)
FIG. 2 shows a typical sequence of discharge force transfer from the gun barrel to the recoil brake in the embodiment of FIG. 1.

FIG. 2 shows a typical vibration sequence that results from the force which, when firing a shot, is transferred from the gun barrel 1 to the recoil brake 3 in an arrangement such as that shown in FIG. 1. In FIG. 2, the horizontal axis is the time axis, while the vertical axis indicates the forces in kN. The sequence shown relates to a test carried out by discharging a given type of shell with a specific propellant charge and gun barrel elevation, and indicates the measured momentary value of the force supplied to the recoil brake, from the instant when the gun is fired (t=0), until 175 ms have elapsed.

After the firing instant, the curve in FIG. 2 rises to an average value of approximately 300 kN, which corresponds to the recoil force of the shell discharge itself. However, when the projectile has left the muzzle completely, an oscillating or vibratory force with large amplitude is added to this average force, which causes the forces supplied to the recoil brake to vary between 0 and 650 kN, i.e., approx. ±100% about said average value. This oscillating force has a frequency which substantially corresponds to the longitudinal natural vibrations of the gun barrel, and is caused by the fact that the gas pressure against the muzzle brake stretches the barrel and causes it to vibrate.

Recoil brakes in known damping devices of the kind shown in FIG. 1 are in principle viscous dampers which serve to transform kinetic energy to thermal energy. By coupling an elastic vibration damper, e.g., a spring, along with such a viscous damper, a visco-elastic damping device is achieved, which according to the invention is designed to attenuate the oscillating forces caused by the natural vibration of the gun barrel.

To achieve effective damping of vibrations, first of all, the natural frequency of the vibratory system constituted by the gun recoil brake and the vibration damper must be adjusted to lie within a desired range on the frequency axis, so that vibrations with frequency above a certain value are strongly attenuated. This is achieved by means of an elastic vibration damper with the right rigidity in relation to the co-vibratory mass of the damping device.

A further damping effect is achieved by the fact that a less rigid damping device (including recoil brake and elastic vibration damper) will allow a larger portion of the forces which originally were transferred from the gun barrel to the recoil brake to be absorbed as inertial forces in the gun barrel and ear. This means that there are less recoil forces transferred to the recoil rod when the elastic vibration damper is installed. This damping effect is an addition to the phase attenuation described above.

Measurements have shown that the longitudinal natural frequency of vibration of a gun barrel with a total length of 6.5 m, including muzzle brake and breech, is approximately 400 Hz. Hence, for the achievement of vibration damping, the natural frequency of the vibrating system which is constituted by the damping device must be substantially lower.

The natural frequency of this system is a function of the total rigidity incorporated in the vibrating system, including the co-vibrating system. Both these quantities are difficult to determine, since both rigidity and mass are unevenly distributed across the system. However, to a certain degree the natural frequency may be estimated from a simplified calculation model. On this basis, the vibration damper is dimensioned and tested so as to achieve a natural frequency which is well below the frequency of the gun barrel vibrations, which to the largest degree possible are to be prevented from transfer to the recoil brake.

Figure 4:
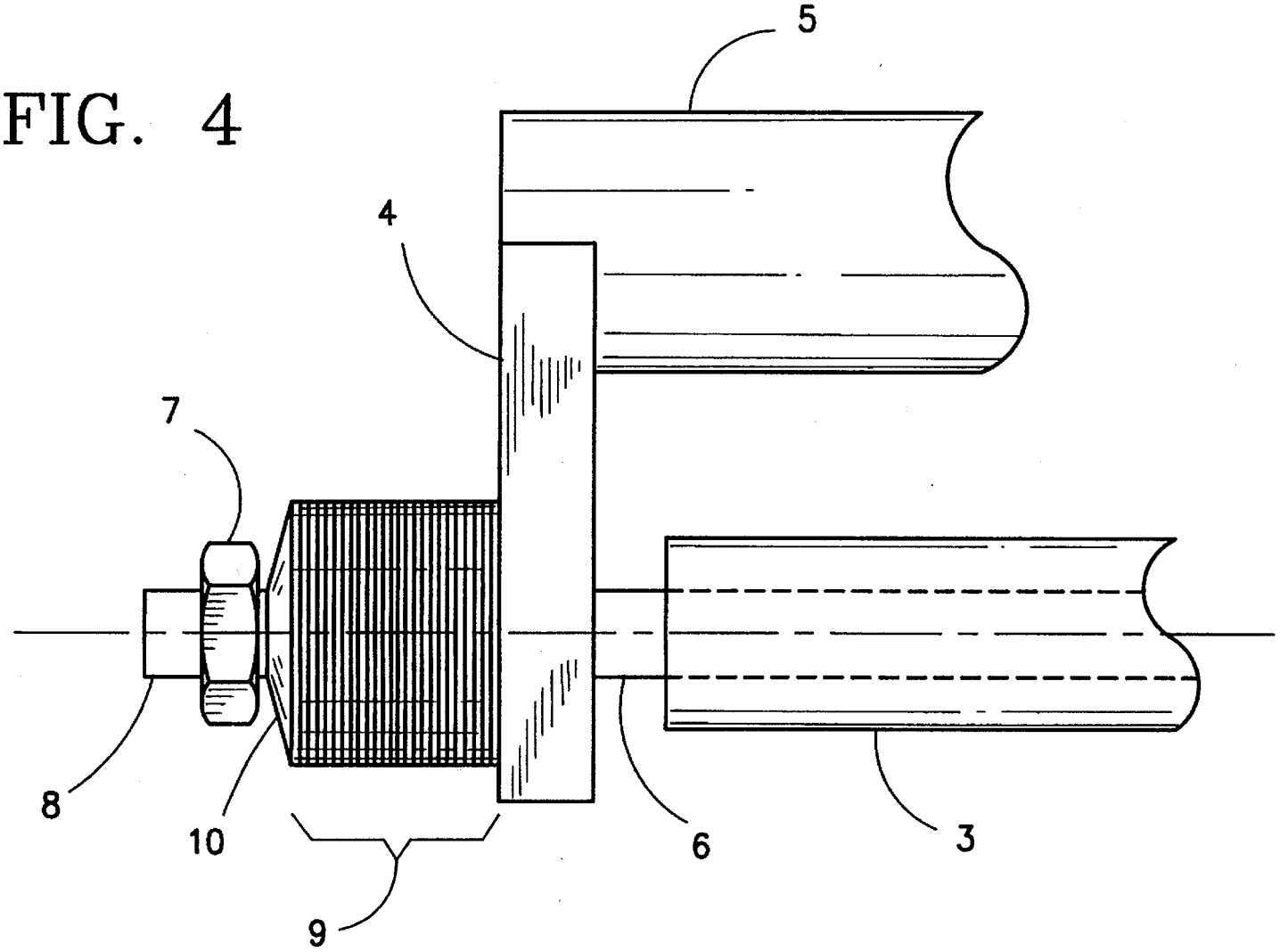
FIG. 4 is an enlarged sectional view of FIG. 1 showing the vibration damper installed according to the invention.

The only kind of spring means which in the present case is suitable for use in the elastic vibration damper, and which is capable of absorbing the forces in question with little deformation, and having restricted eternal geometric dimensions, is Belleville or cup springs. FIG. 3 shows a cross section through a Belleville spring of a vibration damper for the present object, and FIG. 4 shows a series of such Belleville springs 10 assembled to form the desired vibration damper.

In the shown embodiment according to the invention, the large and small diameters a, b of the Belleville spring are determined by the space available on the location where it is to be mounted, i.e., on an extension 8 of the recoil brake rod 6 between connector ear 4 and nut 7. It is also possible to prepare an adapter for the installation of the springs therein, thereby avoiding the need for extending the recoil brake rod itself to obtain enough space for the column of springs. Connector ear 4 in the FIG. 4 embodiment is slidable relative to rod 6, and the nut 7 stops axial motion of the washers 9.

Due to internal shearing forces in the Belleville springs when deflected, a plurality of thin springs must be used instead of a few thick ones. The springs are arranged in a spring column 9 so that the total spring constant equals the sum of the individual spring constants. However, from the table below, which for the present type of Belleville spring shows the relationship between the deflection of an individual spring and its spring force, it appears that the spring force of a spring is not a linear function of the deflection across the entire deflection range of the spring. The largest force is absorbed at a deflection of approximately 3 mm.

| Deflection (mm) | Spring Force (N) |
|---|---|
| 0.5 | 3690 |
| 1.0 | 6410 |
| 1.5 | 8250 |
| 2.0 | 9320 |
| 3.0 | 9740 |
| 3.5 | 9050 |
| 4.0 | 8150 |
| 4.5 | 7040 |
| 5.0 | 5820 |

As demonstrated in FIG. 2, the momentary value of the recoil force varies between 0 and approximately 650 kN. Therefore, there will be no stretch in the springs of the vibration damper and hence, it is sufficient to arrange springs only on one side of the ear 4, thereby exposing the springs to compression only when firing a shot.

Judged by the simple calculation model mentioned above, a number of 50–60 springs mounted on the extension 8 of the recoil brake rod will give the vibrating system a natural frequency of 125–150 Hz, which is well below 400 Hz, i.e., the frequency of the force oscillations exerted on the recoil brake rod.

Figure 5:
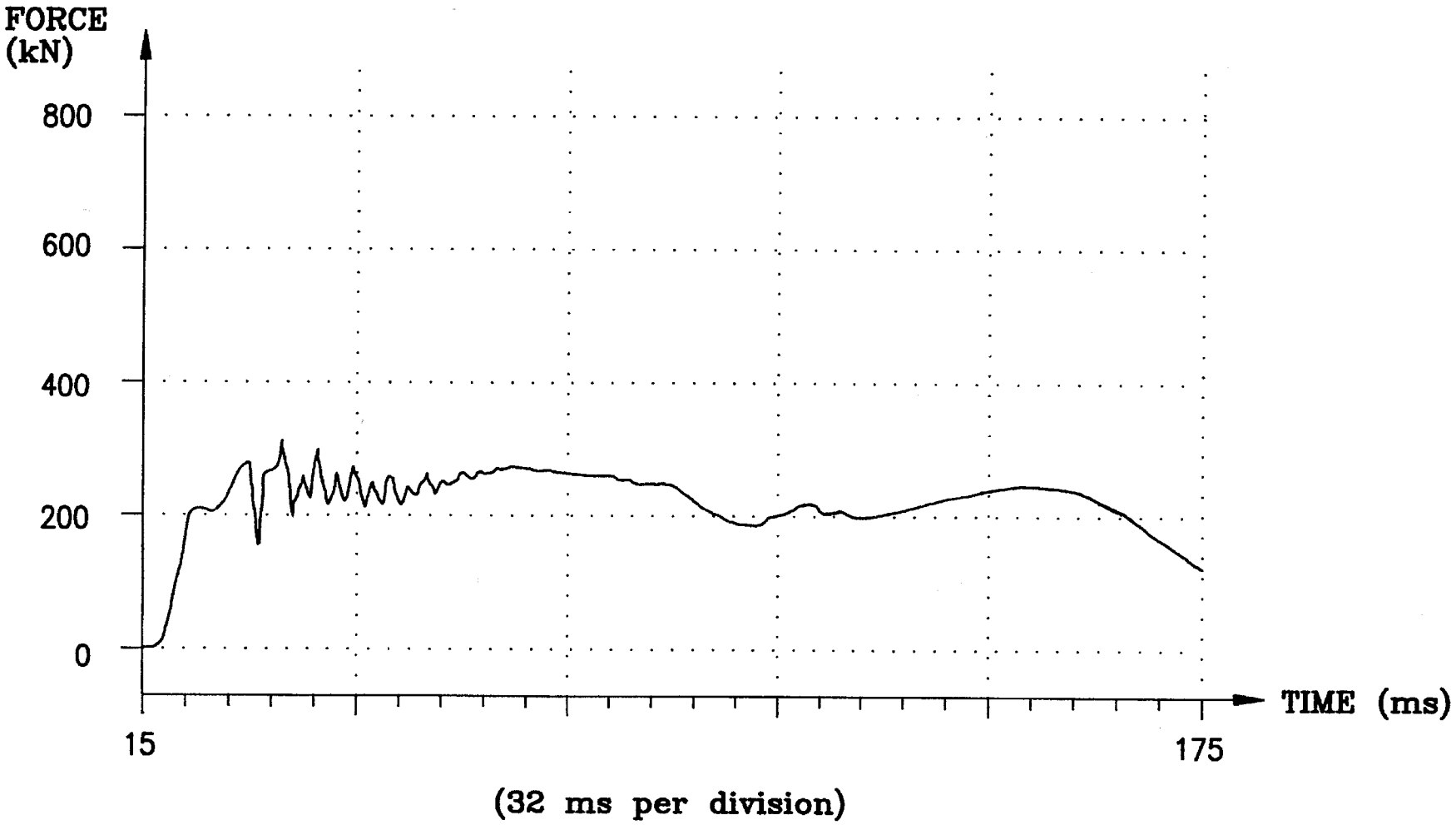
FIG. 5 shows a sequence of the discharged force transfer from the gun barrel to the recoil brake with a vibration damper installed as demonstrated in FIG. 4.

FIG. 5 shows the sequence of the recoil force which, when firing, is transferred from the gun barrel 1 to the recoil brake 3 in the damping device having a vibration damper 9 mounted according to FIG. 4. As in FIG. 2, the vertical axis indicates the forces in kN and the horizontal axis the time in ms. The launching is carried out with the same given type of shell, and the same propellant charge and gun barrel elevation as in the case demonstrated in FIG. 2.

By comparing FIGS. 2 and 5, it clearly appears that a substantial improvement is achieved. The maximum force is reduced to less than half the value, and the vibrations are virtually eliminated. In other words, the sequence of force transfer from gun barrel to recoil brake is changed substantially in a favorable direction.

A note is made of the fact that the longitudinal natural vibrations of the gun barrel are unchanged. The task of the vibration damper is merely to prevent the force oscillations from reaching the recoil brake of the damping device.

We claim:

1. An elastic vibration damper for reducing propagation of natural vibrations induced in a gun barrel having a muzzle brake upon firing to a recoil brake for the gun barrel, said vibration damper being connected between a recoil brake and a gun barrel breech such that the force transfer between the breech and the recoil brake on firing a shot is reduced with respect to said natural vibrations, said vibration damper and said recoil brake connected together to form a damping system having an effective rigidity substantially less than the rigidity of the recoil brake alone; said damping system having a natural frequency substantially lower than the frequency of said natural vibrations of the gun barrel when a shot is fired through the barrel.

2. A vibration damper according to claim 1, wherein the vibration damper comprises a plurality of Belleville springs that are stacked to form a spring column.

3. A vibration damper according to claim 2, wherein said Belleville springs are assembled in such a number that at maximum deflection, the spring stack is capable of elastically absorbing the maximum recoil force to which the recoil brake may be exposed, with the internal shearing forces in each individual spring not exceeding the limit of elasticity of such individual spring.

4. A vibration damper according to claim 2, wherein the Belleville springs are dimensioned to deflect to a predetermined maximum extent when a shot is fired, which maximum deflection approximately corresponds to the deflection at which an individual spring reaches its maximum spring force.

5. A vibration damping system for a gun barrel having a muzzle brake, said system comprising a recoil brake and a vibration damper between the barrel and the recoil brake for preventing natural vibrations generated in the gun barrel when firing a shot from propagating to the recoil brake, said vibration damper being coupled to the recoil brake and a gun barrel breech such that the force transfer between the breech and the recoil brake is reduced with respect to said natural vibrations, said vibration damper comprising a stack of Belleville springs dimensioned such that the damping system as a whole has a rigidity substantially less than the recoil brake alone and forms a vibratory system with a natural frequency substantially lower than the frequency of said natural vibrations of the gun barrel, when a shot is fired through the barrel.

6. A damping device according to claim 5, wherein the connection of said elastic vibration damper to the recoil brake and the gun barrel breech is arranged such that the vibration damper is exposed mainly to compression when a shot is fired through the barrel.

7. A damping device according to claim 5, including an axially movable rod for transferring gun barrel motion to the recoil brake; a connecting member extending between the gun barrel and said rod, said connecting member connected to said rod so as to be relatively slidable relative to the rod and with the recoil brake located on one side of the connecting member; a motion stop element attached to the rod to one side of the connecting member opposite the side on which the recoil brake is located; said stack of Belleville washers disposed between the connecting member and the motion stop element, whereby gun barrel vibrations resulting from firing a shot are transferred to the recoil brake through the rod via the Belleville washer stack and motion stop element.

* * * * *